US006101668A

United States Patent [19]

Grey

[11] Patent Number: 6,101,668

[45] Date of Patent: Aug. 15, 2000

[54] CLEANING HEADS AND ADAPTORS FOR USE THEREWITH

[75] Inventor: Nicholas Gerald Grey, Worcester, United Kingdom

[73] Assignee: Vax Limited, Worcester, United Kingdom

[21] Appl. No.: 09/125,415

[22] PCT Filed: Feb. 13, 1997

[86] PCT No.: PCT/GB97/00401

§ 371 Date: Aug. 17, 1998

§ 102(e) Date: Aug. 17, 1998

[87] PCT Pub. No.: WO97/29675

PCT Pub. Date: Aug. 21, 1997

[30] Foreign Application Priority Data

Feb. 16, 1996 [GB] United Kingdom ..... 9603250

[51] Int. Cl.[7] ..... A47L 9/06

[52] U.S. Cl. ..... 15/322; 15/328; 15/393; 15/401; 15/338

[58] Field of Search ..... 15/320, 328, 322, 15/373, 393, 401, 422, 338

[56] References Cited

U.S. PATENT DOCUMENTS

| | | | |
|---|---|---|---|
| 2,349,371 | 5/1944 | Hirschberg et al. | 15/401 |
| 3,079,626 | 3/1963 | Yonkers et al. | 15/320 |
| 4,413,372 | 11/1983 | Berfield | 15/414 |
| 4,462,137 | 7/1984 | Berfield et al. | 15/353 |
| 4,549,328 | 10/1985 | Martin et al. | 15/328 |
| 4,573,235 | 3/1986 | Baird, Sr. et al. | 15/320 |
| 5,001,806 | 3/1991 | Gurstein | 15/322 |
| 5,060,342 | 10/1991 | Brazier | 15/401 |
| 5,301,387 | 4/1994 | Thomas et al. | 15/393 |
| 5,398,373 | 3/1995 | Blase et al. | 15/322 |

FOREIGN PATENT DOCUMENTS

WO 94/06342 3/1994 WIPO .

*Primary Examiner*—Theresa T. Snider
*Attorney, Agent, or Firm*—Venable; George H. Spencer; Robert Kinberg

[57] ABSTRACT

A cleaning head includes an applicator for applying cleaning liquid to a surface to be cleaned and an air passage for collecting liquid from the surface, enabling the head to be operated in wet mode in which liquid is applied to, and picked up from, the surface. The head also includes a cover adapted to be removably assembled with the cleaning head and which, when in place, effectively encloses the applicator while maintaining communication between the surface and the air passage, thereby enabling the head to be operated in a dry mode to pick up solid matter from the surface.

16 Claims, 5 Drawing Sheets

CLEANING HEADS AND ADAPTORS FOR USE THEREWITH

BACKGROUND OF INVENTION

This invention relates to cleaning heads, for use with or as part of an apparatus for cleaning a surface by application of a cleaning liquid to the surface and removal of the cleaning liquid from the surface by suction.

More particularly, the invention relates to such cleaning heads suitable for use in such cleaning of floor surfaces which are of a relatively unyielding and non-absorbent nature. Examples of materials commonly used for floors or floor coverings, and affording surfaces of the type with which the invention is intended to be used, comprise plastics materials, e.g. vinyl, in the form of a large sheet or small portions constituting "tiles" laid on an underlying supporting surface; ceramic materials, e.g. glazed or unglazed tiles; rubber based materials; or wood, cork or concrete if the surface is sealed with a suitable coating to prevent or reduce absorption of liquid.

There have been many proposals for apparatus for cleaning such surfaces by the application of a cleaning liquid thereto and removal of such liquid, together with dirt removed thereby from the surface, by suction. The cleaning liquid may be water containing a suitable detergent. Cleaning heads for such apparatus, which may be provided as part of single-purpose cleaning appliances or as accessories for multi-purpose cleaning appliances of the suction cleaner ("vacuum cleaner") type, usually include means for distributing the cleaning liquid on to the surface to the cleaned, at least one passage arranged to be connected to a source of suction and having at least one opening arranged to collect liquid from the surface being cleaned, and means for agitating the cleaning liquid whilst in contact with the surface to assist the action thereof in removing dirt from the surface. The agitating means typically comprises at least one brush, a sponge or mop element, e.g. of suitable plastics or rubber foam or cellular material, or a combination thereof.

A cleaning head for such cleaning, and an appliance incorporating the head, are disclosed in our International patent application, Publication No. WO94/06342.

Such cleaning heads cannot normally be used for cleaning surfaces by picking up dry material, particularly from carpeted or upholstered surfaces, without the application of a cleaning liquid, and where an appliance is intended to be used both for wet and for dry cleaning operations, it has been the practice in the past to provide separate and interchangeable heads to perform the respective functions.

This naturally adds to the overall cost of manufacture.

SUMMARY OF THE INVENTION

It is an object of the present invention to provide a cleaning head which can readily be adapted for wet or for dry use by means of a user-removable and replaceable member, i.e. an adaptor.

It will be appreciated that a cleaning head in accordance with the invention normally is used in a predominantly reciprocating motion over the surface being cleaned. Accordingly references herein to the front and rear of the cleaning head, to the length thereof, and analogous expressions, refer to parts of the cleaning head spaced thereon in the intended direction of reciprocation thereof in use, and to dimensions in such direction. Similarly references to the sides of the cleaning head and to the width thereof, and analogous expressions, refer to the direction transverse to the direction of reciprocation of the cleaning head in normal use.

According to one aspect of the present invention, we provide a cleaning head for surface cleaning comprising applicator means for applying cleaning liquid to a surface to be cleaned and air passage means for collection of liquid from said surface thereby enabling the head to be operated in a wet mode in which liquid is applied to, and picked up from, the surface, and in combination therewith a cover means adapted to be removably assembled with said cleaning head and which, when in place, effectively encloses said applicator means whilst maintaining communication between the surface and said air passage means, thereby enabling the head to be operated in a dry mode to pick solid matter from said surface.

According to further aspect of the invention we provide a cleaning head for surface cleaning comprising a housing; agitating means engageable with the surface for agitating cleaning liquid thereon; means for delivery of a cleaning liquid to the surface in the region of the agitating means; air passage means adapted for connection to a source of suction; collecting means, engageable with the surface and communicating with the air passage means, for collection of liquid from the surface by suction; and a removable cover means which when in place effectively encloses said agitating means whilst maintaining communication between the surface and said air passage means so that the head is thereby adapted for picking up dry material from the surface.

The cover means may be formed as a member with a smooth surface-engaging bottom wall to facilitate movement of the head, with the cover member in place, over the surface.

The cover member may be arranged to cover only the agitating means of the head, leaving the collecting means exposed, but preferably the cover member also covers the collecting means and is provided with an inlet opening arranged to provide communication with said air passage means of the head.

Preferably the collecting means includes an opening for flow of air to the air passage means of the cleaning head, which opening extends across substantially the entire width of the cleaning head but is of relatively small dimensions in the direction lengthwise of the cleaning head. Such a configuration of opening enables a high velocity of air flow to be maintained to entrain liquid from the surface being cleaned, rendering collection of liquid highly effective.

Preferably the opening of the collecting means is bounded to front and rear of the opening by flexible blade or squeegee elements engageable with the surface being cleaned. Such blade elements, e.g. of rubber of rubber-like material, render the collection of liquid from the surface by suction more efficient, since their engagement with the surface as the cleaning head is reciprocated wipes the liquid on the surface into a locally increased film thickness to be more readily entrained by the flow of air.

Where the collecting means includes such blade or squeegee elements, to cover means preferably is configured so as to shield said elements from engagement with the surface being cleaned. Thus, the cover means may extend between the lower edges of such elements to define an open mouth extending across substantially the entire width thereof. However, the cover means desirably also includes an airflow defining channel which extends between said elements and towards the air passage means of the head. Such channel may be formed by a pair of parallel flanges upstanding from the bottom wall of the cover member.

The air passage means of the cleaning head preferably has a mouth portion which communicates with the opening of the collecting means and which is of relatively long and narrow cross-sectional shape to cooperate with the collecting means, and a transition portion which changes in cross-sectional shape to a circular or near-circular cross-section for connection to the source of suction. In such transition portion, preferably a substantially uniform cross-sectional area is maintained despite the change in cross-sectional shape, so that air flow at high velocity through the passage means and collecting means is maintained.

The mouth portion preferably connects to the opening of the collecting means at a position generally in the centre thereof and spaced from the sides of the head, so that air flow is established in outermost parts of the collecting means in the direction transversely of the cleaning head, i.e. parallel to the blade elements of the collecting means. This provides for improved entrainment of liquid and thus better drying of the surface being cleaned.

In such a case, the channel in the cover member may be closed at its upper side except for an outlet aperture to register with the mouth portion of the passage means of the head. Alternatively, the channel may be open at its upper side so as to discharge air and dust into an upper portion of the collection means where said blade elements are not exposed.

The underside of the member may be formed with a transverse recess into which said channel opens at its lower end in order to provide an enlarged open mouth adapted to be placed into contact with the surface being cleaned.

The agitating means may be of any conventional form but may conveniently comprise an array of bristles supported to extend from a support member towards the surface to be cleaned, so as to have a scrubbing action upon the surface when the cleaning head is in use. The bristles may be disposed in a number of tufts of bristles, in a line or lines of such tufts extending across the width of the cleaning head.

The agitating means preferably further comprises an element having an operative surface of densely packed thin flexible filaments such as is afforded by a pile fabric. Such an element also acts as a means for spreading the cleaning liquid in such a way that a relatively uniform distribution thereof across the width of the cleaning head will be obtained.

Preferably the means for delivering cleaning liquid to a surface is arranged to deliver such liquid to such an element, which may be backed with an open celled rubber or plastics foam element to render it resilient and assist its spreading of the cleaning liquid.

The agitating means and the collecting means may be relatively movable within the head in a direction which, in use, is generally perpendicular to the surface being cleaned, whereby either one or other of the agitating means and collecting means at least predominantly cooperates with the surface, but it will be understood that the invention is applicable also to cleaning heads in which the agitating means and collecting means are not relatively movable.

According to another aspect of the invention, we provide a cover member for use with a cleaning head for surface cleaning, said head comprising agitating means engageable with the surface for agitating cleaning liquid thereon, means for delivery of a cleaning liquid to the surface in the region of the agitating means; air passage means adapted for connection to a source of suction; and collection means having at least one opening communicating with the underside of the head for the application of suction to the surface; wherein the cover member is adapted to be assembled releasably with the underside of the head so as effectively to enclose said agitating means whilst maintaining communication between the surface and said air passage means of the head, thereby adapting the head for picking-up dry material from the surface.

The cover member may be formed with a smooth surface-engaging bottom wall to facilitate movement of the head, with the cover member in place, over the surface being cleaned, and preferably the cover member also includes upstanding side walls to engage corresponding side walls of the cleaning head.

The bottom wall of the cover member may be so dimensioned and arranged as to cover only the agitating means of the head, leaving the collecting means exposed, but preferably the bottom wall of the cover member is so dimensioned and arranged as to cover also the collecting means of the head, and is formed with an inlet opening arranged to provide communication with said passage means of the head.

According to a further aspect of the present invention we provide a vacuum cleaner of the kind comprising a cleaning head connected to a source of suction to establish suction at said cleaning implement and air flow from said implement to said source of suction, alternatively operable separator units including a wet-mode separator unit which operates to separate entrained liquid droplets from the air flow, and a dry-matter separator unit which operates to separate solid matter entrained in the air flow, and a collection container within a body of the container to receive matter separated from the air flow by said separator in use, wherein said cleaning head comprises applicator means for applying cleaning liquid to a surface to be cleaned and air passage means for collection of liquid from said surface thereby enabling the cleaner to be operated in a wet mode in which liquid is applied to, and picked up from, the surface, and a cover means adapted to be removably assembled with said cleaning head and which, when in place, effectively encloses said applicator means whilst maintaining communication between the surface and said air passage means thereby enabling the cleaner to be operated in the dry mode to pick up solid matter from said surface.

BRIEF DESCRIPTION OF THE DRAWINGS

The invention will now be described by way of example with reference to the accompanying drawings, of which.

DETAILED DESCRIPTION OF THE PREFERRED EMBODIMENTS

Figure 4:
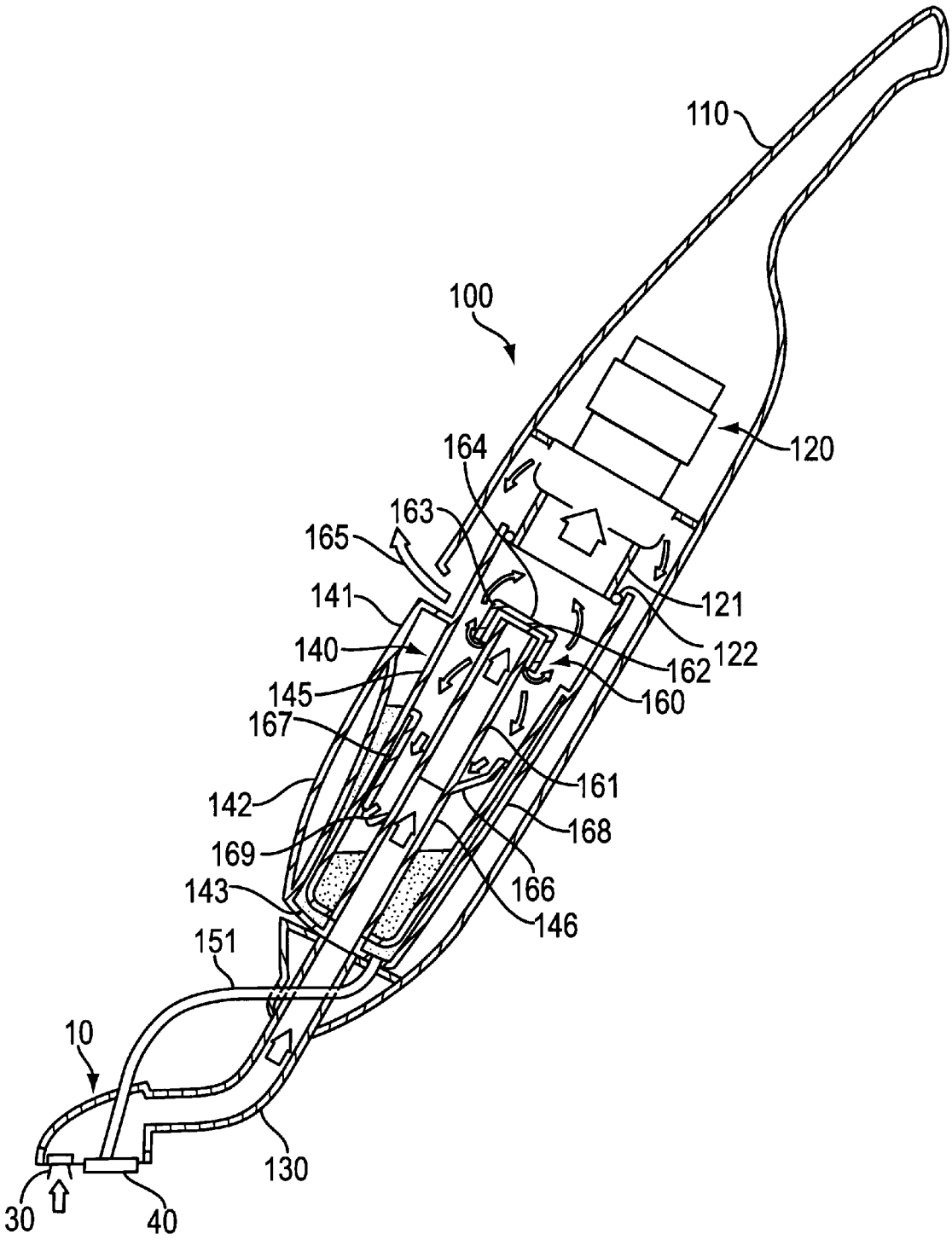
FIG. 4 shows one embodiment of vacuum cleaner incorporating a cleaning head in accordance with the invention and set up in the wet mode.

Referring to the drawings, a cleaning head is indicated generally at 10. The cleaning head is intended primarily to be used as the cleaning head for an appliance such as is shown in FIG. 4 of the drawings of our International patent application Publication No. WO94/06342, but it will be appreciated that a cleaning head could alternatively be useable as part of or in association with another appliance, e.g. as a cleaning head for surface cleaning in connection with a multi-purpose cleaning appliance of the suction cleaner type, for example a illustrated in FIGS. 4 and 5 and may be either mounted as illustrated therein directly at the lower end of an appliance which is used in a generally upright or inclined orientation, or connected at the free end of a suction hose from a free-standing appliance.

Figure 5:
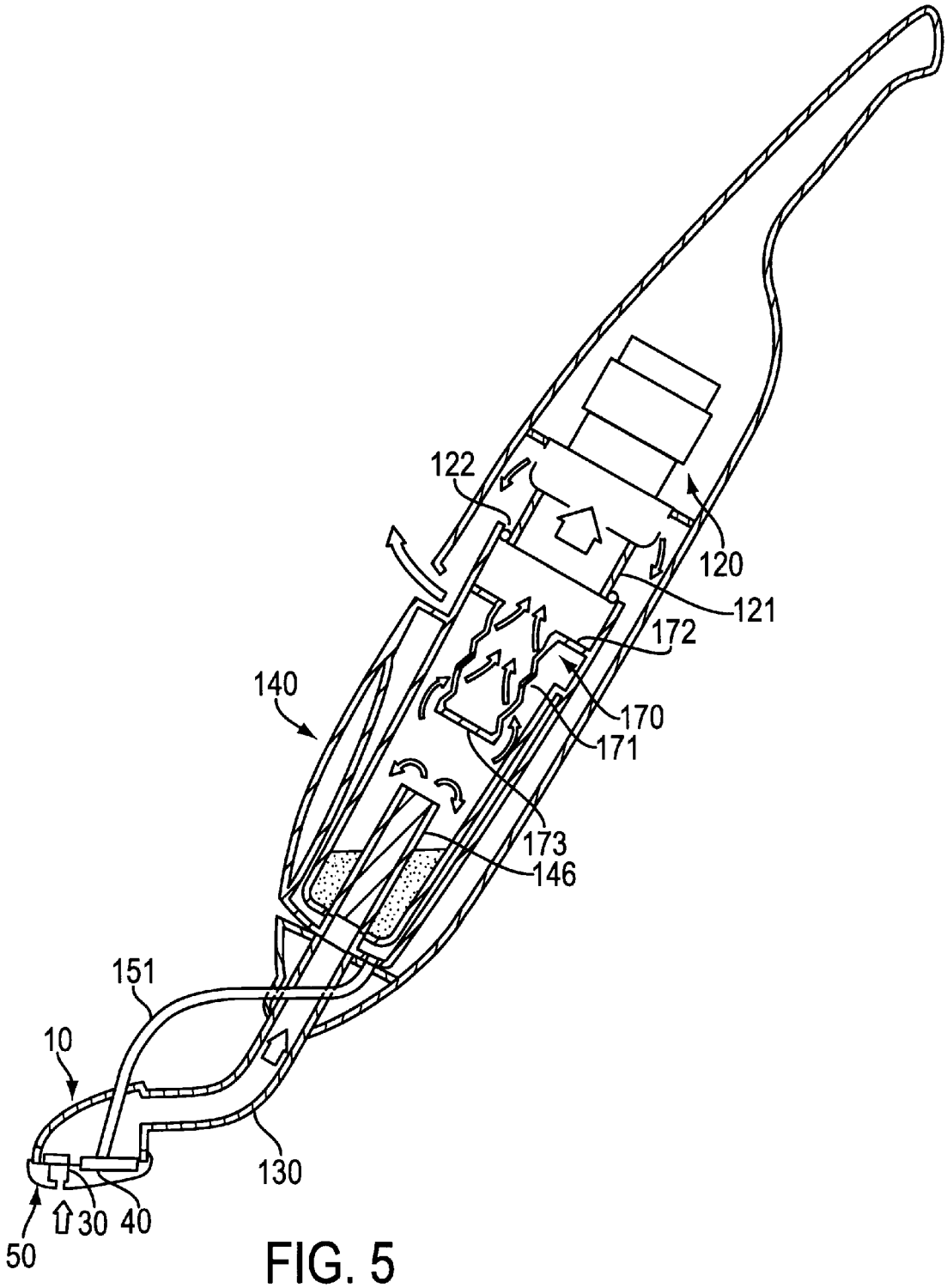
FIG. 5 shows such a cleaner set up in the dry mode.

The head 10 comprises a housing 11 which conveniently is a moulding of a suitable plastic material and which is generally in the form of an inverted shallow trough with a top wall 12 and front, side, and rear walls 13, 14, 15 respectively. Above the top wall 12 and to the rear of the body there is a formation 16 terminating in a spigot 17 which is configured for attachment of the cleaning head to an appliance as shown in FIGS. 4 and 5, or to, for example, the hose of a suction cleaning appliance. The spigot 17 may be adapted to enable the housing 11 to pivot relative to the spigot about a generally transversely extending horizontal axis. Behind the rear wall 15, the body has extensions 18 disposed one to either side of the spigot 17 and in which are supported rollers 19 for engagement with a surface on which the cleaning head is to be used to assist in supporting the cleaning head relative to such surface. Within the formation 16 and spigot 17 there is defined a passage 20 for air flow which communicates with a downwardly facing mouth 21 (FIG. 3) adjacent to the front wall 13 of the head.

The housing 11 of the cleaning head receives a collecting assembly 30 which is co-operable with a surface being cleaned and communicates with the passage 20 for collection of liquid from the surface being cleaned by suction.

Figure 2:
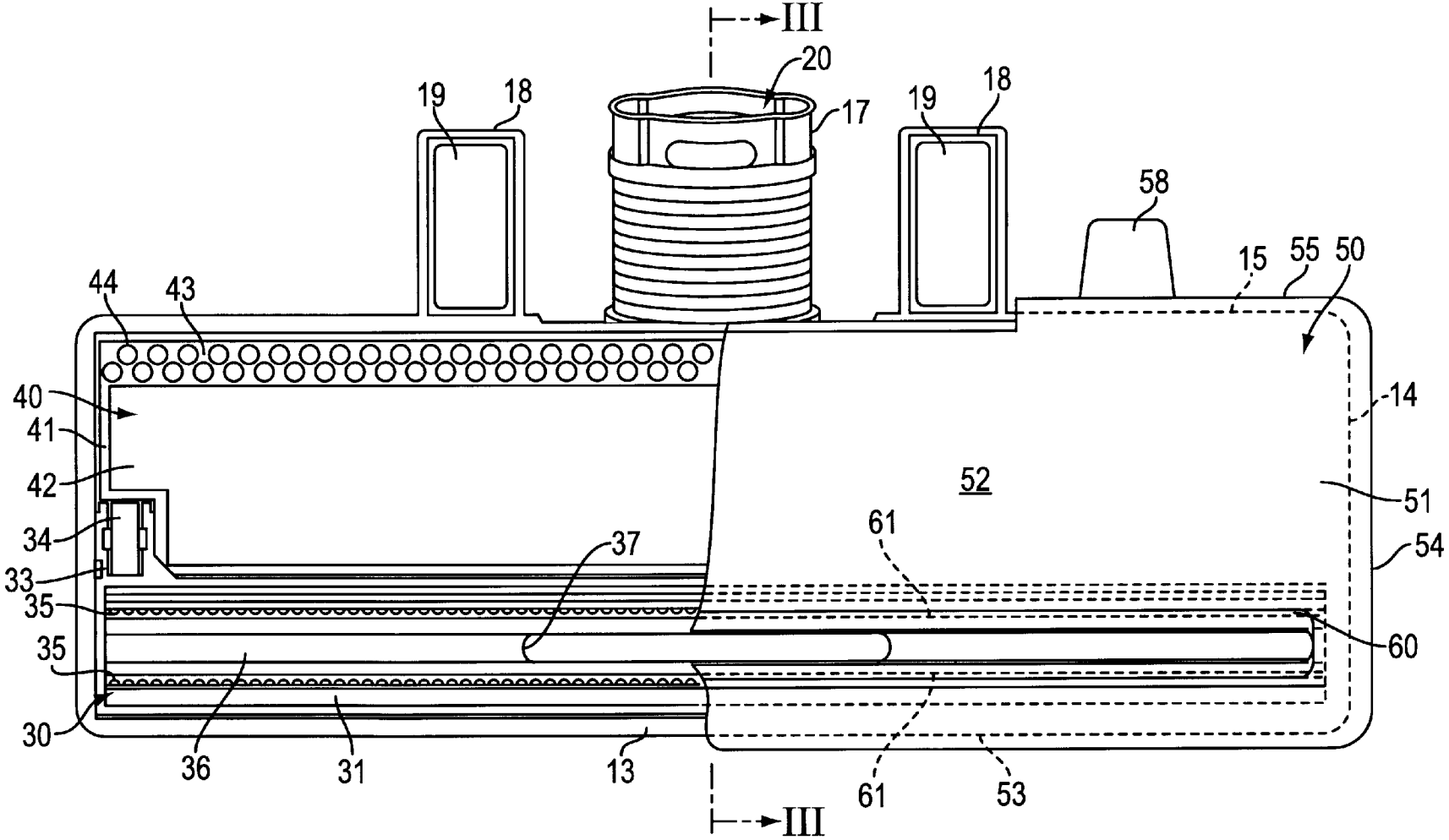
FIG. 2 is a underneath plan view of the cleaning head, with the cover member shown in place and partially broken away.

The collecting assembly 30 comprises a transverse body 31 of inverted U-shape with an elongate aperture 32 which matches the shape of the mouth 21. The body 31 has two rearward extensions 33 at opposite ends thereof (only one of which is shown in FIG. 2) in which further support rollers 34 are carried adjacent to the side walls 14 of the cleaning head. Alternatively support rollers may be provided at the forward side of the body 31.

The body 31 of the collecting assembly 30 accommodates two flexible wiper or squeegee blades 35 spaced from one another in the direction forwardly and rearwardly of the cleaning head and held therein by a retaining member 36 of inverted U-shape secured by screws (not shown) and having a central aperture 37 in register with the aperture 32.

The housing 11 of the cleaning head further accommodates an applicator assembly 40 comprising means for delivery of cleaning liquid to the surface being cleaned and agitating means adapted to agitate such liquid to assist the cleaning operation.

The applicator assembly 40 comprises a body 41 supporting an agitating means comprising a pad 42 including an open-celled foam plastics block with a fibre pile facing layer. The body 41 also supports on a rearward portion 43 thereof two rows of tufts of bristles 44. However, the bristles 44 may be omitted and instead of the pad 42 which is relatively wide in the fore-and-aft direction, in an alternative embodiment a transverse applicator strip of reduced width in the fore-and-aft direction may be employed.

Figure 3:
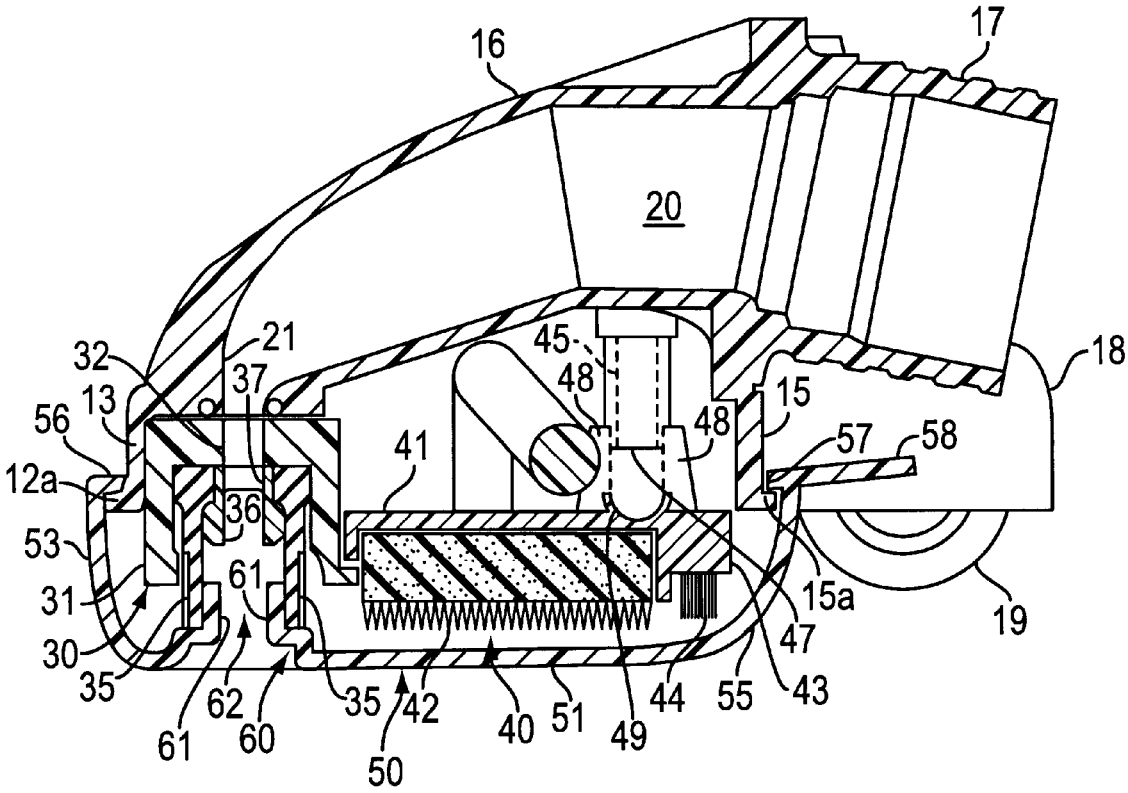
FIG. 3 is a section on the line III—III of FIG. 2.

In the illustrated embodiment the applicator assembly 40 is mounted for upward and downward movement relative to the housing 11 by means of a foot pedal and linkage mechanism so that when the applicator assembly 40 is in its lowest position the pad 42 and bristles 44 project substantially below the bottom edge of the housing 11, and when the assembly 40 is raised into an inoperative position the pad and bristles are substantially retracted into the housing 11. However, for the purposes of the present invention, the applicator assembly need not be retractable in this manner, but instead can be fixed in an operative position as illustrated in FIG. 3.

For delivering cleaning liquid, which will usually be water containing a suitable detergent, to the agitating pad 42 and thus to the surface being cleaned, the housing 11 has a liquid passage 45 extending from an inlet spigot 46, for connection to a flexible tube leading to a reservoir of cleaning liquid in known manner, to an outlet spigot 47 which is arranged within a pair of generally semi-cylindrical walls 48 that form a local enlargement of a trough formation 49 provided at the upper side of the body 41 of the applicator assembly 40. The trough formation 49 extends laterally across substantially the entire width of the applicator assembly and the body 41 is formed with a plurality of spaced apertures (not shown) which provide communication from the trough formation 49 to the underside of the body 41, and thence to the applicator pad 42.

In an alternative embodiment, the trough may be formed as in inverted channel at the opposite side of the body 41 and closed at its underside by a closure plate carried by the agitating pad 42, one side wall of the channel having spaced along the length thereof a plurality of notches that are not closed by the closure plate, whereby liquid from the channel can flow onto a side face of the pad and run down that side face rollers than through the thickness of the pad.

The head 10 is thus intended primarily for cleaning hard floor surfaces by the application of a cleaning liquid using the applicator assembly 40 and thereafter drying by suction using the collection assembly 30.

In accordance with the present invention, the head 10 is adapted by means of a cover member 50 for use for the pick-up of dry material from hard to carpeted surfaces.

The cover member 50 comprises a shallow tray-like body having a bottom wall 51 with a generally smooth underface 52 for sliding movement over the surface being cleaned, and front, side and rear walls 53,54 and 55. The member 50 is dimensioned so as to fit around the walls 13 to 15 of the head 10. The front wall 53 of the cover is formed with an inturned lip 56 which engages over a rim 12*a* at the lower edge of the front 12 of the head, and the rear wall 55 of the cover member is formed with a pair of inturned lips 57 which engage releasably over a rim 15*a* at the lower edge of the rear wall 15 of the head. Finger tabs 58 rearwardly of the lips 57 enable the user to flex the rear wall 55 to facilitate assembly and removal of the cover member 50 relative to the housing 11 of the cleaning head.

Parallel to the front wall 53, the bottom wall 51 of the cover member is formed with a shallow transversely extending recess 60, centrally of which is a pair of upstanding flanges 61 spaced in the forward and rearward direction by a distance slightly less than the spacing between the blades 35 so as to enclose the blades as shown in FIG. 3. The slot 62 defined by the flanges 61 opens into the space within the body 31 of the collecting assembly 30. Suction is thus applied to the recess 60 from the mouth 24 at the underside of the head, thereby enabling the head to be used for normal vacuuming operations, whilst the applicator assembly 40 is effectively enclosed by the cover member 50.

Thus the same pick-up head 10 can be used for both dry and wet operation by application or removal of the cover member 50, and FIGS. 4 and 5 respectively show a cleaner in wet and dry modes in accordance with the invention.

One embodiment of convertible suction cleaner incorporating a cleaning head as above described is illustrated in FIGS. 4 and 5 by way of example. This includes a body 100 which defines a housing for various operative components, including a motor/impeller unit 120 which provides a source of suction to draw air through a suction duct 130 and into a removable collection container 140 which is housed in a recess provided within the body 100.

The body 100 is formed to afford a handle assembly 110 at its upper end and, at its lower end, carries the suction head 10.

In the illustrated embodiment, the collection container 140 comprises an outer body 141 of generally jig-like form having an integral handle 142 on the wall thereof which in use is outside relative to the recess in the body within which the container 140 is received.

In the illustrated embodiment, the outer body 141 of the container 140 serves as a reservoir compartment for clean water (normally containing a detergent or the like) which can be delivered to the suction head 10 by means of a liquid delivery pipe 151 which is releasably connected to the lower end of the outer body 141, desirably with the interposition of valve means (not shown) whereby the flow of liquid to the cleaning head can be regulated. However, it would be possible for the outer body 141 to be omitted where cleaning by the application of liquid is not required, the appliance then serving only to pick up liquid in the wet mode and dry matter in the dry mode.

The container 140 further comprises an inner compartment 145 which extends upwardly beyond the upper end of the outer body 141 and at its upper end is adapted to engage sealingly with an intake duct 121 of the motor/impeller unit 120, for example by means of an interposed sealing ring 122.

The inner compartment 145 is adapted to collect dry or wet material picked up by the suction head 10 and conveyed along suction duct 130.

For this purpose, the inner compartment 145 of the container 140 includes a suction passage comprising a central suction tube 146 which extends upwardly from the base 143 of the outer body 141 and through the base of the inner compartment 145 to a position approximately one third of the way up the height of the inner compartment 145. At its lower end, the tube 146 is releasably connectable to the suction duct 130 in any convenient manner.

Figure 1:
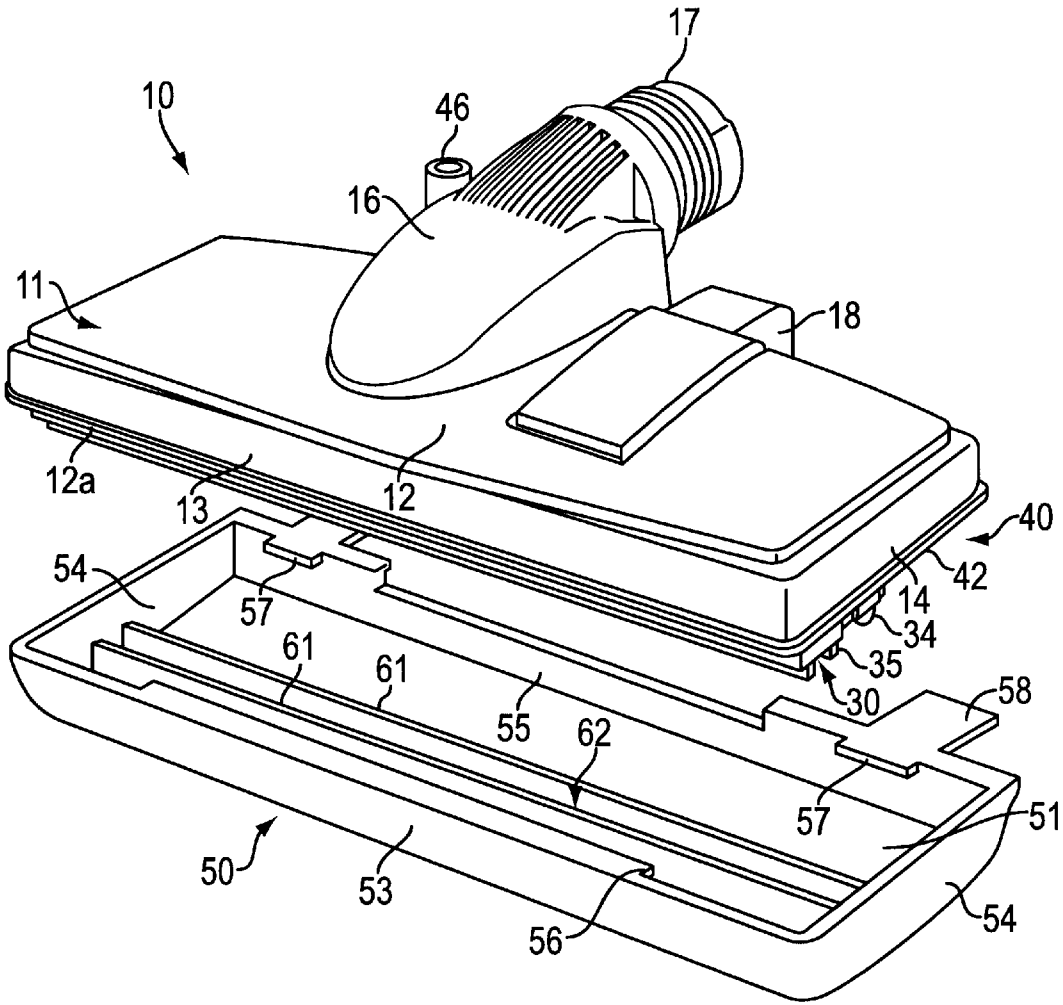
FIG. 1 is a perspective view of a cleaning head in accordance with the invention with a cover member shown in spaced relation thereto.

The inner compartment 145 of the collection container 140 is adapted to receive, interchangeably, one of two separator units 160,170 in order to place the apparatus in a wet pick-up mode and a dry pick-up mode as respectively illustrated in FIGS. 1 and 2.

The wet-mode separator unit 160 comprises a tube 161 which is releasably connectable at the upper end of the suction tube 146 so as to form an extension thereof. At its outer end 162 the tube 161 carries a cap 163 which includes an end wall 164 of greater diameter than the tube 161 in register with, and spaced from, the outlet end 162 of the tube to serve as a baffle, and a circumferential skirt 165 which overlaps with an end portion of the tube 161 in spaced relation therefrom, whilst also being spaced from the side wall of the inner compartment 145 as shown in FIG. 1. Thus, in use air with liquid droplets entrained is drawn from the suction head 10, through the suction duct 130, tubes 146 and 161, and undergoes a sharp reversal of flow within the cap 163, in a manner which efficiently separates liquid droplets before the air flow is again reversed and drawn into the intake duct 121 of the motor/impeller assembly 120. Liquid separated from the air flow can then drain downwardly into the base of the inner compartment 145.

Preferably, the inner compartment 145 also includes an obliquely disposed annular baffle plate 166 which assists in retaining collected liquid in the base of the inner compartment as the apparatus is moved back and forth.

In the illustrated embodiment, the baffle plate 166 is provided at an oblique end face of an upwardly extending tubular wall 167 which terminates at its upper end in an outwardly directed flange 168 which engages the inner faces of the side walls of the inner compartment, an outlet aperture 169 being formed at the lowest point of the baffle plate 166 at its junction with the wall 167 to allow liquid to be discharged into the base portion of the inner compartment. The baffle plate is arranged so that the aperture 169 is positioned against the side of the inner compartment which is uppermost when the appliance is in use. The baffle 166 prevents spillage of collected liquid into the part of the compartment above the baffle plate if the appliance is laid down and minimites sloshing of the collected liquid due to back and forth movement of the appliance in use. An upwardly extending outlet tube (not shown) may be provided at the uppermost point of the baffle plate 166, diametrally opposed to the aperture 169, to enable the contents of the inner compartment 145 to be emptied without removing the baffle plate assembly, such outlet tube normally being closed at the upper end by means of a suitable removable stopper.

The assembly of baffle plates 166, tubular wall 167 and flange 168 may be removably located within the inner compartment 145 so as to facilitate emptying and cleaning of the latter after use.

The baffle plate 166 may be secured to, and carried by, the tube 161 of the separator unit 160 so as to form an effectively permanent part thereof, in which case it may be disposed nearer to the cap 163 than illustrated so as to increase the available volume of the inner compartment 145 beneath the baffle plate 66. In other embodiments, the baffle plate 166 may be releasably assembled with the tube 161, or with the suction tube 146 of the collection container.

In an alternative arrangement, the tubular wall 167 and flange 168 may be omitted so that the baffle plate 166 then engages around its periphery directly with the internal face of the inner compartment 145, except where the aperture 169 is required.

For operation in the dry mode, the cover member 50 is assembled with the head 10 and the wet-mode separator unit 160 is removed from the inner compartment 145 of the collection container 140 and the dry-mode separator unit 170 is inserted at the upper end of the inner compartment 145 as shown in FIG. 5. Alternatively it would be possible to employ a separate collection container with the dry-mode separator unit 170 incorporated therein. Such a separate collection container need not then be formed with an outer reservoir and inner compartment, and the volume available for collection of solid matter could accordingly be increased.

The dry-mode separator 170 comprises essentially any suitable filter element. In the illustrated embodiment a tubular filter element 171 carried by a mounting ring 172, the lowermost end of the filter element being closed by a baffle plate 173, on which air emerging from the tube 161 impinges so as to cause flow-reversal and to assist the separation of coarser particles before the air stream passes through the filter material which removes finer particles. However, it will be appreciated that other forms of filter may be employed if desired. Separated dust and other matter falls to the bottom of the inner compartment as shown, and the container 140 as a whole can be removed laterally from the recess in the housing for emptying.

Whilst in the above description the cleaning head 10 is adapted to apply a cleaning liquid by means of the applicator assembly 40, the invention is also applicable to a cleaning head of a kind adapted only to pick-up liquid, for example comprising a collecting assembly similar to assembly 30 which includes squeegee blades and an associated suction means. In this case the cover member may be configured so as to at least partially enclose and shield the squeegee blades.

What is claimed is:

1. A cleaning head comprising:

applicator means for applying cleaning liquid to a surface to be cleaned;

air passage means for collection of liquid from said surface, thereby enabling the head to be operated in a wet mode in which liquid is applied to, and picked up from, the surface; and cover means adapted to be removably assembled with said cleaning head and which, when in place, effectively encloses said applicator means while maintaining communication between the surface and said air passage means thereby enabling the head to be operated in a dry mode to pick up solid matter from the surface.

2. A cleaning head for surface cleaning, comprising:

a housing;

agitating means engageable with the surface for agitating cleaning liquid thereon;

means for delivery of a cleaning liquid to the surface in the region of the agitating means;

air passage means adapted for connection to a source of suction;

collecting means, engageable with the surface and communicating with the air passage means, for collection of liquid from the surface by suction; and a removable cover means which when in place effectively encloses said agitating means while maintaining communication between the surface and said air passage means so that the head is thereby adapted for picking up dry material from the surface.

3. A cleaning head according to claim 2 wherein the cover means is formed as a member with a smooth surface-engaging bottom wall to facilitate movement of the head (10), with the cover member in place, over the surface.

4. A cleaning head according to claim 2 wherein the cover means is so shaped and arranged as to cover both the agitating means and the collecting means, and is provided with an inlet opening so disposed as to provide communication with said air passage means of the head.

5. A cleaning head according to claim 4 wherein the collecting means includes an opening for flow of air to the air passage means of the cleaning head, which opening extends across substantially the entire width of the cleaning head but is of relatively small dimensions in the direction lengthwise of the cleaning head.

6. A cleaning head according to claim 5 wherein the opening of the collecting means is bounded to front and rear of the opening by flexible blade or squeegee elements engageable with the surface being cleaned.

7. A cleaning head according to claim 6 wherein the cover means is so configured as to shield said blade or squeegee elements from engagement with the surface being cleaned.

8. A cleaning head according to claim 7 wherein the cover means extends across the lower edges of said elements and defines an open mouth extending across substantially the entire width of the head.

9. A cleaning head according to claim 8 wherein the cover means includes flanges which extend between said elements and define an air-flow channel leading towards the air passage means of the head member.

10. A cleaning head according to claim 5 wherein the air passage means has a mouth portion which communicates with the opening of the collecting means and which is of relatively long and narrow cross-sectional shape to cooperate with the collecting means, and a transition portion which changes in cross-sectional shape to a circular or near-circular cross-section for connection to the source of suction.

11. A cleaning head according to claim 10 wherein in said transition portion a substantially uniform cross-sectional area is maintained despite the change in cross-sectional shape, so that air flow at high velocity through the passage means and collecting means is maintained.

12. A cleaning head according to claim 10 wherein said mouth portion connects to the opening of the collecting means at a position generally in the centre thereof and spaced from the sides of the head, so that air flow is established in outermost parts of the collecting means in the direction transversely of the cleaning head.

13. A cleaning head according to claim 9 wherein the underside of the cover member is formed with a transverse recess into which said channel opens at its lower end, which recess provides an enlarged open mouth adapted to be placed into contact with the surface being cleaned.

14. A cleaning head according to claim 2 wherein the agitating means and the collecting means are relatively movable within the head in a direction which, in use, is generally perpendicular to the surface being cleaned, whereby either one or other of the agitating means and collecting means at least predominantly cooperates with the surface.

15. A cover for use with a cleaning head for surface cleaning, the head including applicator means for applying cleaning liquid to a surface to be cleaned and air passage means for collection of liquid from the surface, thereby enabling the head to be operated in a wet mode in which liquid is applied to and picked up from the surface, the cover comprising:

a cover member adapted to be removably assembled with the cleaning head and which when assembled in place effectively encloses the applicator means while maintaining communication between the surface and the air passage means, thereby enabling the head to be operated in a dry mode to pick up solid matter from the surface.

16. A cover member according to claim 15 comprising a smooth surface-engaging bottom wall to facilitate movement of the head, with the cover member in place, over the surface being cleaned.

* * * * *